United States Patent [19]

Hartle

[11] 4,211,535

[45] Jul. 8, 1980

[54] GASOLINE FUEL COMPOSITIONS CONTAINING ANTIKNOCK ADDITIVE

[75] Inventor: Robert J. Hartle, Gibsonia, Pa.

[73] Assignee: Gulf Research and Development Company, Pittsburgh, Pa.

[21] Appl. No.: 931,612

[22] Filed: Aug. 7, 1978

[51] Int. Cl.[2] ..... C10L 1/18

[52] U.S. Cl. ..... 44/68; 44/77; 252/386

[58] Field of Search ..... 44/68, 77; 252/386

[56] References Cited

U.S. PATENT DOCUMENTS

| | | | |
|---|---|---|---|
| 3,047,375 | 7/1962 | Pellegrini, Jr. | 44/77 |
| 3,261,674 | 7/1966 | Condo, Jr. | 44/77 |
| 3,794,473 | 2/1974 | Eisentraut et al. | 44/68 |
| 4,036,605 | 7/1977 | Hartle | 44/68 |
| 4,133,648 | 1/1979 | Deffner | 44/77 |

*Primary Examiner*—Winston A. Douglas
*Assistant Examiner*—Y. Harris-Smith

[57] ABSTRACT

A gasoline motor fuel possessing improved antiknock characteristics contains a minor amount of an aliphatic $\beta$-diketone and a minor amount of a chelate of cerium-(IV) with a $\beta$-diketone.

6 Claims, No Drawings

GASOLINE FUEL COMPOSITIONS CONTAINING ANTIKNOCK ADDITIVE

This invention relates to gasoline motor fuels which have additives to enhance the antiknock properties of the gasoline.

In my U.S. Pat. No. 4,036,605, I describe the preparation of novel β-diketone chelates of cerium(IV) and their use in motor gasoline as antiknock agents. I have now discovered that if sufficient aliphatic β-diketone, which is itself inactive as an antiknock agent, is added to this gasoline mixture containing the chelate of cerium(IV) with a β-diketone, the antiknock characteristics of the gasoline are unexpectedly further elevated.

The useful β-diketone synergists are branched compounds which are represented by the general formula $R_1$—CO—$CH_2$—CO—$R_2$where $R_1$ and $R_2$ are alkyl radicals, with at least one being branched, having from 1 to about 8 carbon atoms and a total of at least 5 carbon atoms. Preferred compounds include 2,2-dimethyl-3,5-hexanedione; 3,3-dimethyl-4,6-octanedione; 2,2,6-trimethyl-6-ethyl-3,5-octanedione and 2,2,6,6-tetramethyl-3,5-heptanedione (thd). The most preferred compounds are the most highly branched β-diketones.

The useful cerium(IV) chelates are prepared from β-diketones represented by the formula $R_3$—CO—$CH_2$—CO—$R_4$ where $R_3$ and $R_4$ are alkyl, aralkyl or cycloalkyl radicals each containing from 1 to 12 carbon atoms with a total of 5 to about 20 carbon atoms in said radicals. The preferred chelates of cerium(IV) contain the branched aliphatic β-diketones and the most preferred chelates of cerium(IV) contain the highly branched aliphatic β-diketones. A more detailed description of these cerium(IV) chelates and their preparation is found in U.S. Pat. No. 4,036,605, which disclosure is incorporated herein by reference.

The gasoline fuel composition desirably contains from about 0.01 to about 5 g. per gallon of cerium as the cerium(IV) chelate and from about 0.5 to about 20 g. per gallon of the β-diketone synergist for an improved antiknock rating and preferably contains from about 0.05 to about 2 g. per gallon of cerium as the cerium(IV) chelate and from about 2 to about 10 g. per gallon of the β-diketone.

EXAMPLES 1-16

A series of motor fuel compositions were tested for octane rating by the motor method (MON by ASTM D2700) and the research method (RON by ASTM D2699) using a clear commercial automotive gasoline having an MON of 83.2 and an RON of 91.0. The cerium(IV) chelate that was used was tetrakis(2,2,6,6-tetramethyl-3,5-heptanedionato)cerium or $Ce(thd)_4$. The results of these experiments are set out in the following table in which each listed difference in octane numbers is based on consecutive, matched determinations with the β-diketone present and absent.

| Ex. | Ce g./gal. | β-diketone | g./gal. | ΔMON | ΔRON |
|---|---|---|---|---|---|
| 1 | 0 | thd | 4.0 | 0 | 0 |
| 2 | 0.5 | thd | 4.0 | +0.6 | +1.4 |
| 3 | 0.5 | thd | 4.0 | +0.2 | +1.1 |
| 4 | 1.0 | thd | 1.0 | +0.3 | +0.3 |
| 5 | 1.0 | thd | 2.0 | +0.1 | +0.6 |
| 6 | 1.0 | thd | 4.0 | +0.3 | +1.0 |
| 7 | 1.0 | 2,2-dimethyl-3,5-hexanedione | 4.0 | +0.4 | +0.2 |
| 8 | 0.2 | 2-methyl-4,6-heptanedione | 2.0 | 0 | +0.6 |
| 9 | 1.0 | 3,5-heptanedione | 4.0 | 0 | −0.2 |
| 10 | 1.0 | acetylacetone | 4.0 | −0.2 | −0.8 |
| 11 | 1.0 | trifluoroacetylacetone | 4.0 | −0.4 | +0.2 |
| 12 | 1.0 | 1,3-cyclohexanedione | 4.0 | 0 | −0.1 |
| 13 | 1.0 | 5,5-dimethyl-1,3-cyclohexanedione | 4.0 | 0 | −0.3 |
| 14 | 1.0 | 2-acetylcyclohexanone | 4.0 | −0.6 | −1.1 |
| 15 | 1.0 | benzoylacetone | 4.0 | −0.2 | 0 |
| 16 | 1.0 | dibenzoylmethane | 4.0 | −0.8 | −1.1 |

It is noted from this table that the β-diketones of Examples 9-16 undesirably lower one or both of the octane numbers of the fuel composition.

I claim:

1. A gasoline motor fuel composition comprising a major amount of gasoline and a small amount, sufficient to improve the antiknock characteristics of the gasoline, of a free β-diketone and a chelate of cerium(IV), a. said free β-diketone represented by the formula $R_1$CO—$CH_2$—CO—$R_2$ where $R_1$ and $R_2$ are alkyl radicals with at least one being branched, each having from 1 to about 8 carbon atoms and having a total of at least 5 carbon atoms, and b. said chelate of cerium(IV) is the tetrakis chelate with a β-diketone represented by the formula $R_3$—CO—$CH_2$—CO—$R_4$ where $R_3$ and $R_4$ are alkyl, aralkyl or cycloalkyl radicals, each containing from 1 to 12 carbon atoms and the sum of the carbon atoms in said radicals is 5 to about 20.

2. The gasoline motor fuel composition of claim 1 wherein the free β-diketone is present in an amount of about 2 to about 10 g. per gallon and the chelate of cerium(IV) is present in an amount sufficient to incorporate about 0.05. to about 2 g. of cerium per gallon.

3. The gasoline motor fuel composition of claims 1 or 2 wherein $R_1$, $R_2$, $R_3$, and $R_4$ are branched chain alkyl groups.

4. The gasoline motor fuel composition of claim 3 wherein $R_1$, $R_2$, $R_3$, and $R_4$ are the same.

5. The gasoline motor fuel composition of claims 1 or 2 wherein the β-diketone is 2,2,6,6,tetramethyl-3,5-heptanedione.

6. The gasoline motor fuel composition of claim 5 wherein the chelate of cerium(IV) is tetrakis(2,2,6,6-tetramethyl-3,5-heptanedionato)cerium.

* * * * *